US006158450A

United States Patent [19]

Painter

[11] Patent Number: 6,158,450

[45] Date of Patent: Dec. 12, 2000

[54] EPICYCLOIDIC INDUSTRIAL CLEANING SYSTEM

[76] Inventor: Paul W. Painter, 38850 Town Hall, Mt. Clemens, Mich. 48045

[21] Appl. No.: 09/249,285

[22] Filed: Feb. 10, 1999

[51] Int. Cl.[7] ..... B08B 3/02; B08B 3/04

[52] U.S. Cl. ..... 134/95.3; 134/104.1; 134/142; 134/145; 134/161

[58] Field of Search ..... 134/95.2, 95.3, 134/142, 161, 144, 145, 104.1

[56] References Cited

U.S. PATENT DOCUMENTS

| | | | |
|---|---|---|---|
| 532,523 | 1/1895 | Blakeslee | 134/142 |
| 3,192,935 | 7/1965 | Hanifan | 134/142 |
| 5,368,053 | 11/1994 | Wilson | 134/95.2 |
| 5,526,841 | 6/1996 | Detsch et al. | 134/95.2 X |

OTHER PUBLICATIONS

Immerso–Jet Cleaning System Brochure of Ransohoff Co., Hamilton, OH 45011; Undated, Believed Dated Before Feb. 1998.

CycloJet 3 Cleaning System Brochure of Better Engineering Mfg, Inc., Baltimore, MD 21236; Dated Jan. 1997.

Immerso–Jet HC–4 Cleaning System Fact Sheets (3) of Ransohoff Co., Hamilton, OH, 45011; Undated, Believed Dated Before Feb. 1998.

Cabinet–Turbo–Washer Cleaning System Brochure of Bowden, Ind. Huntsville, AL 35816; Undated, Believed Dated Before Feb. 1998.

Aqua–Fast Cleaning System Brochure of FPI Systems, Inc., North Haven, CT 06473; Undated, Believed Dated Before Feb. 1998.

*Primary Examiner*—Philip R. Coe

*Attorney, Agent, or Firm*—Peter D. Keefe

[57] ABSTRACT

An industrial parts cleaning system including immersion and spraying which provides epicycloidic parts movement (a plurality of revolutions per rotation, wherein the revolution is supersposed the rotation), rotating spray which synchronously follows the parts rotation, and a purge system for evacuating from the common plumbing the respective wash or rinse solution of a current cycle before commencement of the next cycle. The cleaning system includes, a housing, a rinse tank for holding rinse solution, a wash tank for holding wash solution, a process tank, a parts carrier including at least one support frame for supportably receiving parts to be cleaned, an epicycloidic drive mechanism for providing a plurality of revolutions per rotation of each support frame, a central spray system for providing rotatively synchronous spray onto each respective support frame, plumbing for selectively interconnecting the rinse tank, wash tank, process tank and the central spray system, a source of heating for the wash solution and the rinse solution, an air dry nozzle array, a source of pressurized air for the nozzle array, and a purge system for purging the common plumbing between cycles.

10 Claims, 11 Drawing Sheets

Fig. 13

| CYCLE | STAGE / PROGRESS | WASH INLET VALVE 172 | RINSE INLET VALVE 208 | WASH RETURN VALVE 192 | RINSE RETURN VALVE 210 | DUMP WASH VALVE 232 | DUMP RINSE VALVE 236 | PROCESS TANK DRAIN VALVE 228 | ENDUCTOR VALVE 180 | WASH SPRAY VALVE 202 | RINSE SPRAY VALVE 218 | PURGE SPRAY SYS VALVE 242 | LINE PURGE VALVE 246 | WASH PURGE RETURN VALVE 254 | RINSE PURGE RETURN VALVE 258 | PRIME MOVER 332 | AIR DRY SYSTEM 158 | HEATING SYSTEM 153 | PUMP 176 | BRAKE 386 | DOOR ACTUATOR 140 |
|---|---|---|---|---|---|---|---|---|---|---|---|---|---|---|---|---|---|---|---|---|---|
| | LOAD PARTS | ● | | | | | | | | | | | | | | ● | | | | ● | ● |
| WASH | FILL | | | ● | ● | | | | ● | ● | | | | | | | | | ● | | |
| WASH | WASH | | | | | | | ● | ● | ● | | | | | | ● | | ● | ● | | |
| WASH | MAIN DRAIN | | | | | ● | | ● | | | | | | | | ● | | ● | ● | | |
| | AIR DRY / PURGE SPRAY | | | | | | | | | | | ● | | | | ● | | ● | | | |
| | RESIDUAL DRAIN | | | ● | | ● | | ● | | | | | | ● | | | ● | ● | | | |
| | LINE PURGE | | | | | | | | | | | | ● | | | | | ● | | | |
| | | | | | | | | | | | | | | | | | | ● | | | |
| RINSE | FILL | | ● | ● | ● | | | | ● | | ● | | | | | | | ● | ● | | |
| RINSE | RINSE | | | | ● | | | ● | ● | | ● | | | | | ● | | | | | |
| RINSE | MAIN DRAIN | | | | ● | | ● | ● | | | | | | | | ● | | | ● | | |
| | AIR DRY / PURGE SPRAY | | | | | | | | | | | ● | | | | ● | ● | | | | |
| | RESIDUAL DRAIN | | | | ● | | ● | | | | | | | | | ● | ● | | ● | | |
| | LINE PURGE | | | | | | | | | | | | ● | | ● | ● | ● | | | | |
| | UNLOAD PARTS | | | | | | | | | | | | | | | ● | | | | ● | ● |

EPICYCLOIDIC INDUSTRIAL CLEANING SYSTEM

BACKGROUND OF THE INVENTION

1. Field of the Invention

The present invention relates to cleaning systems used in industrial settings for, typically, the cleaning of parts after manufacturing processes have been completed.

2. Description of the Prior Art

Cleaning of parts is an essential step in the manufacturing process. For example, during the manufacture and machining of parts, surfaces of the parts may retain coatings of industrial chemicals, and/or the parts may have geometries which harbor chips or other solid debris. In order to clean parts of coatings and debris, cleaning systems are utilized. In a typical cleaning machine, a wash, rinse and dry cycle are provided. During the wash cycle a pressurized wash solution is sprayed forcefully onto the parts, and the parts are also passed periodically through a bath of the wash solution. During the rinse cycle, the parts are sprayed with a rinse solution and passed through a bath of the rinse solution. During the drying cycle, the parts are subjected to blowing of air. Some prior art cleaning systems are known to incorporate filtration for the wash and rinse cycles and to have programmable controller (referred to most of ten, and referred to herein, as "CPU", and sometimes as "PLC") control of the cycling. These cleaning systems are also known to provide parts basket rotation.

Unfortunately, multi-basket prior art cleaning systems suffer from a fixed location spray head assembly which only effectively cleans the parts closest thereto. Therefore, any particular part is cleaned best only periodically when the basket rotates past the spray head assembly, and, unfortunately, the spray directly strikes the same side of the basket each time as this side passes the spray head assembly with each revolution. These cleaning systems further suffer from single cyclic rotary movement of the baskets which tends to limit the efficacy of passage through the bath, be that the wash solution or the rinse solution. Lastly, these cleaning systems suffer from cross-feed of the wash and rinse solutions due to remnants thereof remaining in the common plumbing lines when cycling is undertaken. Accordingly, the wash tank will become diluted in time, and, in time, the rinse tank will become contaminated by the wash solution, resulting in frequent solutions changing. Cross-solution contamination necessitates changing before the solution would have otherwise failed in use without cross-contamination occurring.

Accordingly, what remains needed in the art is a cleaning system which provides simultaneous epicycloidic (multi-cyclic) movement of the parts to be cleaned, rotating spray which synchronously follows the rotation of the parts, and a purge system for vacating solution the from the common plumbing of a current cycle before commencement of the next cycle.

SUMMARY OF THE INVENTION

The present invention is an industrial parts cleaning system including immersion and spraying which provides epicycloidic parts movement (a plurality of revolutions per rotation), rotating spray which synchronously follows the parts rotation, and a purge system for evacuating from the common plumbing the respective wash or rinse solution of a current cycle before commencement of the next cycle.

The cleaning system according to the present invention includes, generally, a housing, a rinse tank for holding rinse solution, a wash tank for holding wash solution, a process tank, a parts carrier including at least one support frame for supportably receiving parts to be cleaned, an epicycloidic drive mechanism for providing a plurality of revolutions per rotation of each support frame, a central spray system for providing rotatively synchronous spray onto each respective support frame, plumbing for selectively interconnecting the rinse tank, wash tank, process tank and the central spray system, a source of heating for the wash solution and the rinse solution, an air dry nozzle array, a source of pressurized air for the nozzle array, and a purge system for purging the common plumbing between cycles.

The parts carrier and epicycloidic drive mechanism are characterized as follows.

A hollow support shaft is nonrotatably connected with the sidewalls of the process tank, wherein left and right end orifices thereof are connected, respectively, to the plumbing. The support shaft is provided with a plurality of holes regularly spaced along its length. A hollow driven shaft is concentrically centered on and mounted to the support shaft by a pair of sleeve bearings whereby the driven shaft is rotatable with respect to the support shaft.

A prime mover, such as an electric motor and a gear reduction drive unit therefor, has a drive gear situated on a side of the process tank. A driven gear is gearingly interfaced with the drive gear and is fixedly mounted to the driven shaft, whereby when the prime mover is actuated, the driven shaft responsively rotates. At the opposite end of the driven shaft is a sun gear fixedly mounted with respect to the sidewall of the process tank in concentric relation to the support shaft.

The parts carrier includes at least one support frame, preferably three, which interfaces with removable parts holders, such as for example baskets. Each parts carrier further includes right and left connector plates which are fixedly connected in a radially disposed relation to the driven shaft. Each support frame is rotatably connected at either end to the right and left connector plates. One end of each support frame, opposite the drive and driven gears, is provided with a fixedly connected planetary gear which is gearingly interfaced with the sun gear. Accordingly, when the prime mover is actuated, the driven shaft rotates, each support frame rotates with the rotation of the driven shaft, and as a result of the sun-planetary interaction, also simultaneously revolves on the axis of its respective planetary gear, thereby providing an epicycloidic movement of each support frame.

The central spray system is characterized as follows.

The support shaft receives rinse or wash solution into the central chamber thereof and the pressure thereof causes passage through the plurality of holes and into the annular chamber formed between the support and driven shafts. With the annular chamber pressurized by the solution, the solution vigorously sprays radially outwardly through axially arranged sets of regularly spaced spray apertures which are disposed so as to radially face each support frame. For example, where there are three support frames, which is preferred, each support frame is provided with a respective set of spray apertures.

Accordingly, when the plumbing system is delivering either wash or rinse solution into the process tank, a bath of the solution has been provided and the epicycloidic drive mechanism is actuated, the support frames are periodically immersed in the bath and the solution sprays out through the sets of spray apertures continuously upon its respectively facing support frame, wherein the spray encounters all sides axially as each support frame revolves (and, consequently, whatever parts are supported by the support frames).

As a result of the epicycloidic movement of the support frames, the parts are continually jostling with each other, while being constantly exposed to solution spray, and a rotating/revolving movement through the solution bath is provided, the combination of which providing superb cleaning of the parts carried by the support frame.

Further, upon conclusion of either the rinse or wash cycles, pressurized air is selectively introduced into the common plumbing to force solution of the former cycle back toward its respective tank, prior to commencement of the next cycle. Accordingly, there is no mixing of the rinse and wash solutions during cycle change, and, therefore, the wash and rinse solutions have a maximal extended lifetime before changing is necessitated by contamination from the parts (as opposed to being necessitated because of solution cross-contamination).

Accordingly, it is an object of the present invention to provide a cleaning system, wherein parts being cleaned are subjected to an epicycloidic movement which combines rotation with revolution.

It is an additional object of the present invention to provide a cleaning system wherein solution is continuously sprayed upon each part carrier in a synchronized manner.

It is yet another object of the present invention to provide a cleaning system wherein the plumbing is purged between cycles to thereby prevent cross-solution contamination.

These, and additional objects, advantages, features and benefits of the present invention will become apparent from the following specification.

BRIEF DESCRIPTION OF THE DRAWINGS

FIG. 13 is a schematic of the cycles and stages of operation in relation to the active components associated respectively therewith of the epicycloidic cleaning system according to the present invention.

DETAILED DESCRIPTION OF THE PREFERRED EMBODIMENT

Figure 1:
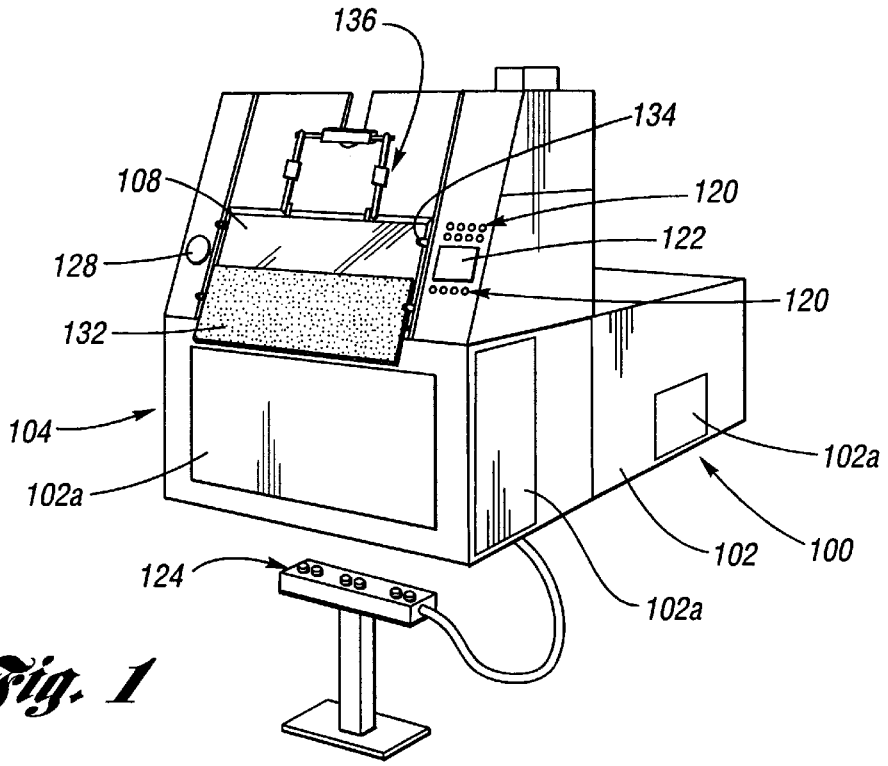
FIG. 1 is a perspective elevational view of the epicycloidic cleaning system according to the present invention, wherein the portal door is shown closed.
Figure 2:
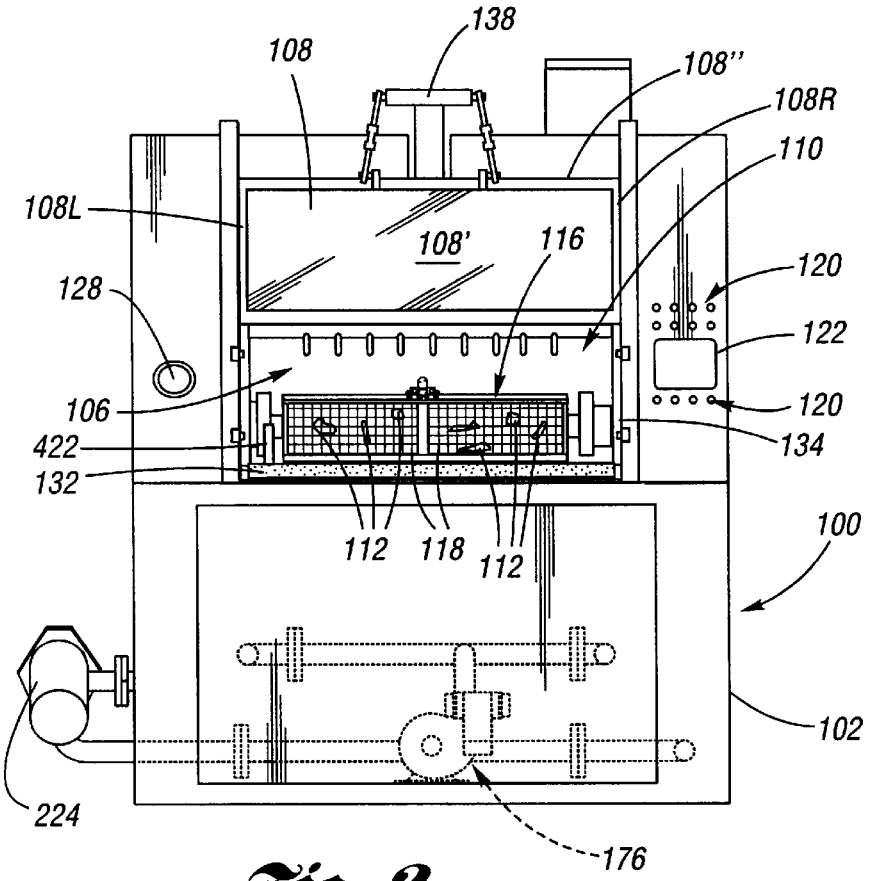
FIG. 2 is a front elevational view of the epicycloidic cleaning system according to the present invention, wherein the portal door is shown open.

Referring now to the Drawing, FIGS. 1 and 2 show elevational views of the epicycloidic cleaning system 100 according to the present invention. The epicycloidic cleaning system 100 includes a housing 102 which is preferably composed of stainless steel. The housing 102 provides structural mounting and placement, as well as protection, for the various components, mechanisms, and systems of the epicycloidic cleaning system 100. A plurality of access covers 102*a* are provided in the housing 102 for accessing selected components having potential for periodic inspection and/or service, such as for example, valves, electronics, filters, etc.

The front end 104 of the housing 102 is characterized by a main portal 106 which is selectively coverable by a see-through portal door 108. When open, as shown at FIG. 2, the main portal 106 provides a service entry into a process tank 110 whereat parts 112 to be cleaned are retained on a parts carrier 14 via at least one support frame 116. In this regard, it is preferred for selectively openable enclosures in the form of open-wire baskets 118 to collectively restrain the parts 112, and for the baskets to be securely received in a removable manner with respect to the support frame 116. It is preferred for each of three support frames 116 to retain two baskets 118, but the number of support frames 116 and number of baskets 118 supported on each support frame may be otherwise.

A control button bank 120 (including burner control, master start, power on, auto cycle, end cycle, master stop, and auto selector), and a multi-menu touch screen 122 for operator input of instructions to a CPU 126 (see FIG. 5*a*) are provided on the housing 102. A remote, free standing operator button station 124 is also preferably provided which requires, as a safety feature, two-handed involvement in order to press buttons to cause actuation of the epicycloidic cleaning system 100 and to effect actuation of the portal door 108. The control button bank 120, the touch screen 122, and the button station 124 are electrically connected to the CPU 126 for providing computer directed control of the active components associated with each operational stage of the epicycloidic cleaning system 100, as will be detailed hereinbelow.

A pressure gauge 128 is mounted to the housing 102 to provide an indication of the solution pressure within the plumbing 168 (see FIG. 14) during operation of the epicycloidic cleaning system 100.

A loading platform 132 is preferably provided which is pivotally mounted to the housing 102 at the main portal 106, which serves as an aid for loading and unloading the baskets 118 and their respectively restrained parts 112.

Figure 5:
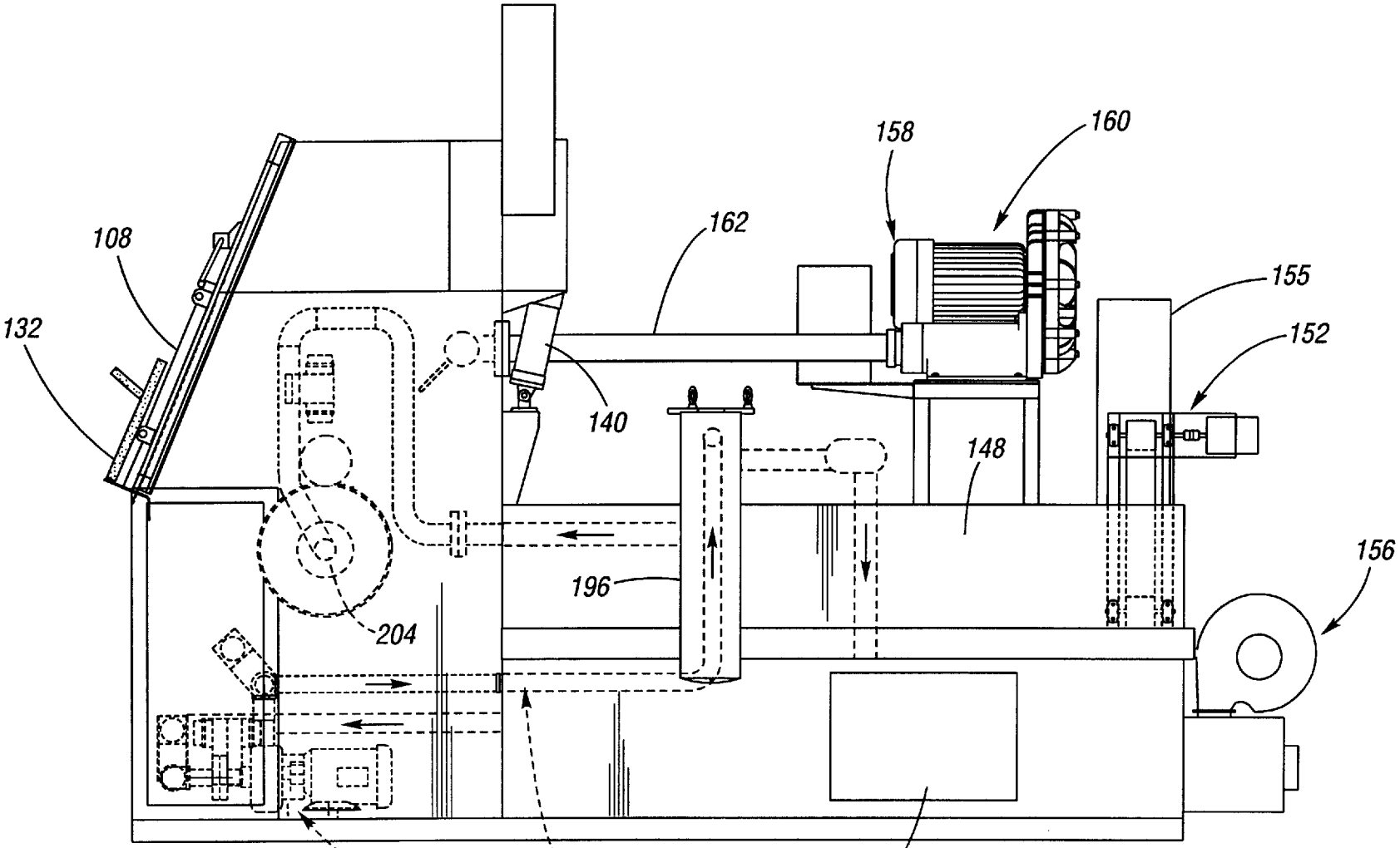
FIG. 5 is a right side view of the epicycloidic cleaning system according to the present invention, showing in particular a portion of the wash plumbing.
Figure 6:
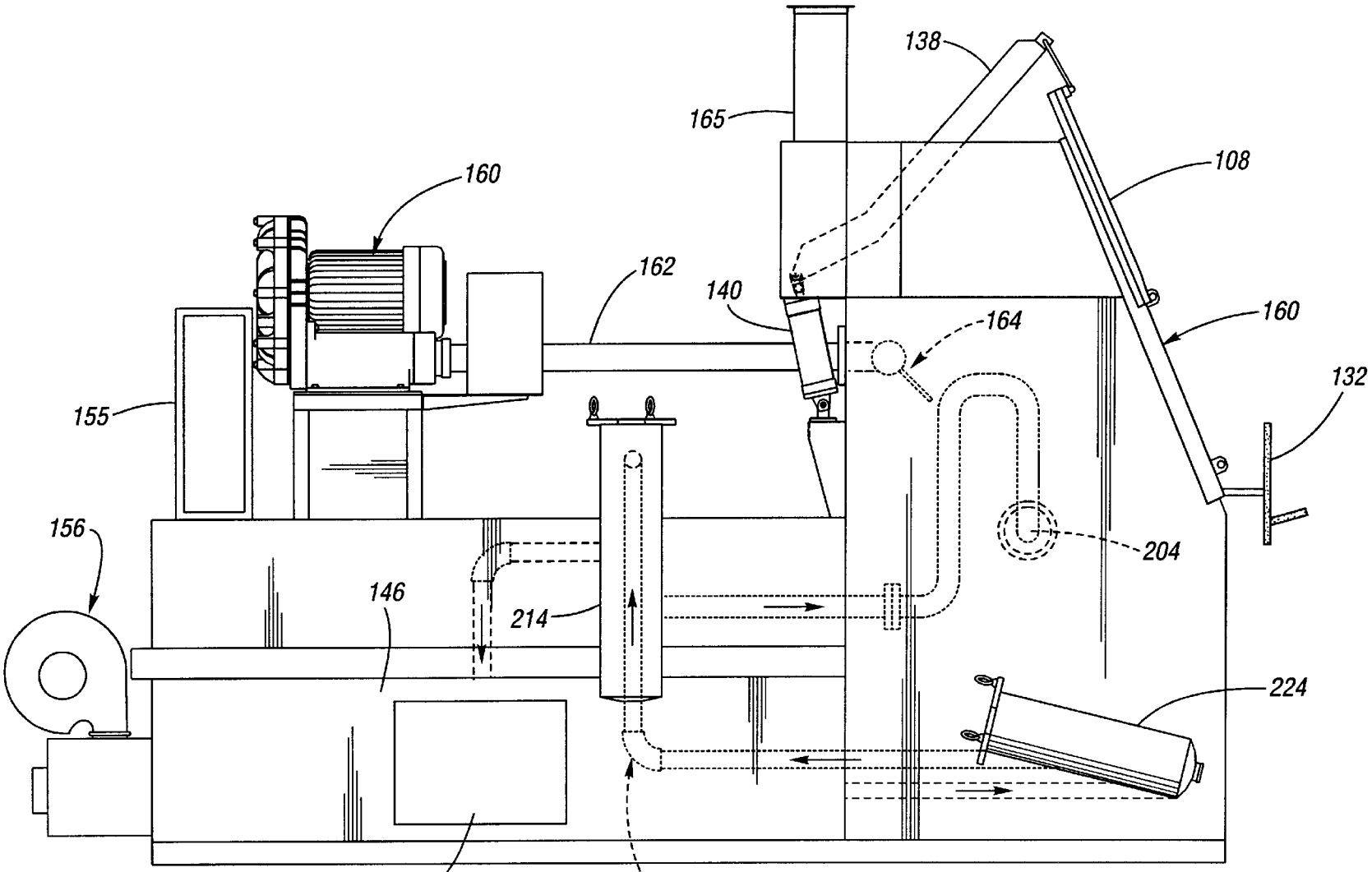
FIG. 6 is a left side view of the epicycloidic cleaning system according to the present invention, showing in particular a portion of the rinse plumbing.

The main portal 106 is selectively openable by the portal door 108 being raised and lowered slidably with respect to a portal frame 134 of the housing 102 via a clevis-type linkage 136 pivotally connected to an arm 138, which is, in turn, raised and lowered by actuation of a pneumatic portal door actuator 140 (see FIGS. 5 and 6). An example of a preferred pneumatic portal door actuator 140 is an 8" stroke clevis mount air cylinder manufactured by Fabco.

Figure 3:
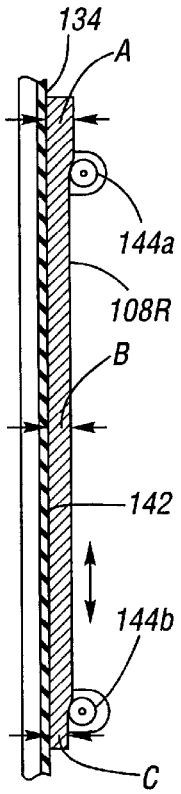
FIG. 3 is a partly sectional end view of the portal door and its associated mounting hardware.

The portal door 108 includes a clear panel 108', preferably composed of one-half inch thick Lexan, and further includes a stainless steel portal door frame 108" at the periphery of the clear panel. The left and right sections 108L, 108R of the portal door frame 108" are provided with progressively thinner cross-sections A, B and C, as shown at FIG. 3. The portal frame 134 includes a gasket 142 which lines the periphery of the main portal 106, preferably of a two inch wide, double raised nib contact type elastomer. The portal door 108 is slidably guided with respect to the main portal 106 by a pair of cam rollers 144*a*, 144*b* located at each of the left and right sides of the main portal.

As shown at FIG. 3, the cam rollers 144*a*, 144*b* rollably interact with the respective left and right frame sections 108L, 108R, wherein as the next thicker cross-section engages each cam roller, the portal door 108 is pressed sealably against the gasket 142, so that when the portal door is at the closed position as shown at FIG. 1, the process tank 110 is sealed. The cam rollers 144*a*, 144*b* are preferably mounted adjustably for an operator to adjust the pressed seal between the portal door 108 and the gasket 142. When the portal door 108 is in the raised position as shown at FIG. 2, the portal door is free of the cams, and is swingable away from the housing 102 on the pivot of the arm 138 for providing easy cleaning of the interior side (ie., process tank side) of the clear panel 108'.

Figure 4:
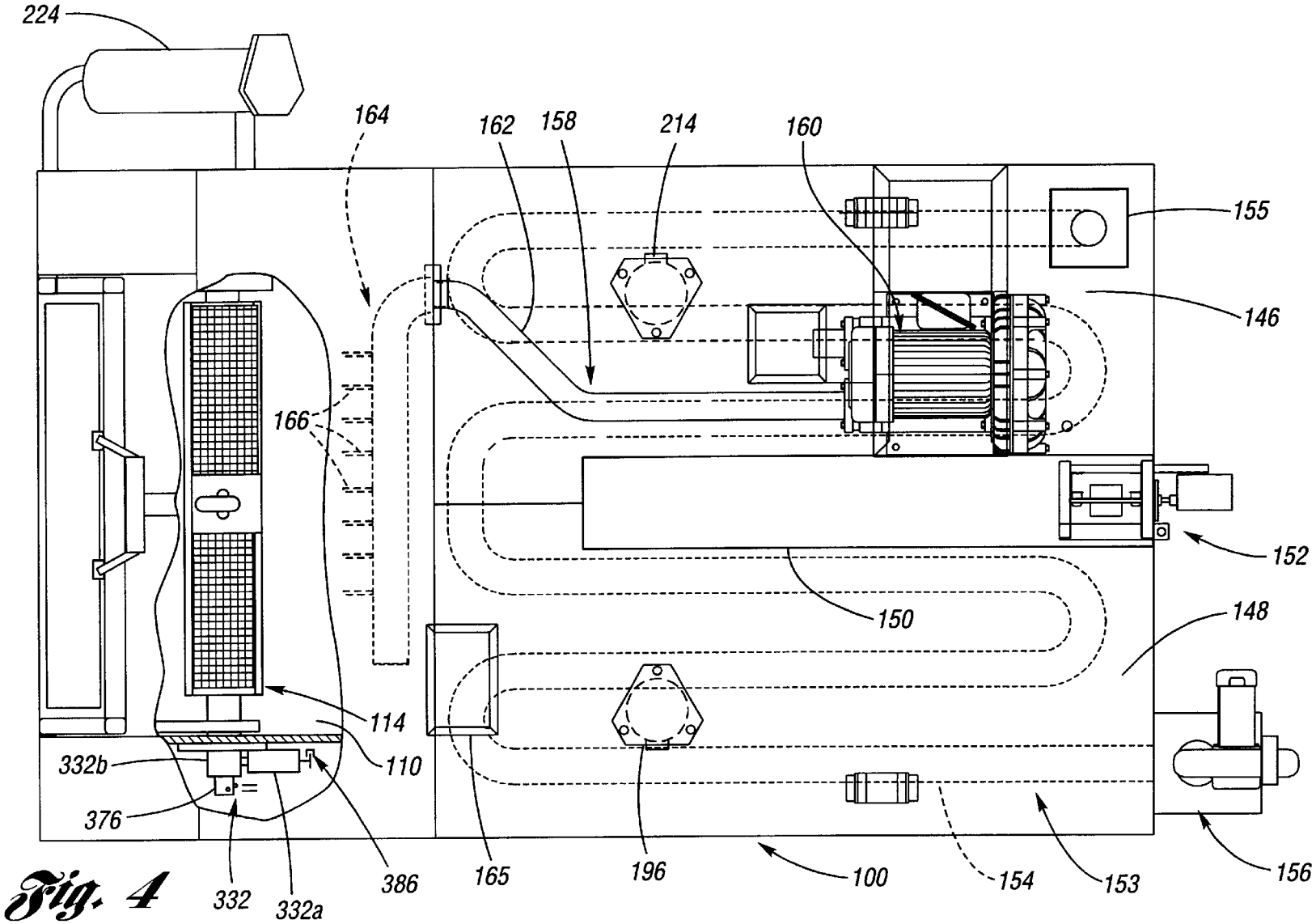
FIG. 4 is a partly broken-away top plan view of the epicycloidic cleaning system according to the present invention, showing in particular the solution heating and air dry systems.

As shown at FIG. 4, the epicycloidic cleaning system 100 includes a rinse tank 146 for holding rinse solution, a wash tank 148 for holding wash solution, the aforementioned process tank 110, and an over-flow tank 150 for solution over-flow of the rinse and wash tanks. The over-flow tank 150 includes an oil skimmer apparatus 152 of conventional design. A preferred oil skimmer apparatus 152 is model DB6 of DPI which includes a loop of stainless steel extending into the over-flow tank and supported by rollers at either end, wherein one of the rollers is rotated by an electric motor, and wherein any oil film acquired from the solution in the over-flow tank is removed by a rubber wiper (see also FIG. 14). In a typical operation of the over-flow tank, wash solution over-flows thereinto upon completion of the wash cycle and the oil skimmer removes scum and other floating residues. The over-flow tank may be periodically pumped-out and the contents disposed of in an environmentally sound manner, or the over-flow tank may have a connection line to the wash tank whereby its contents merge with the wash solution in the course of the wash cycle.

A solution heating system 153 includes at serpentine heater conduit 154 passing through each of the wash and rinse tanks 148, 146, and a heater-blower unit 156 for heating and blowing air through the heater conduit 154, whereupon the air exits at an exhaust 155. In operation, heated air passes through the heater conduit, transferring heat to the wash and rinse solutions. The amount of heat transferred is regulated so that the temperature of the wash and rinse solutions is user selectable, as by user selection on a page of the touch screen 122. The heater unit 156, situated adjacent the wash tank 148, includes an electric blower and the heat is provided, preferably, by a natural gas burner, as for a preferable example, a Maxon Tube-O-Therm 900,000 BTU burner model 51-47063. Heat may be alternatively supplied, as for example electrically, by another fuel, or by steam. In this regard, the natural gas burner, or other heat supplying apparatus, is connected in a conventional, known manner with the CPU 126 for control thereby.

An air dry system 158 is provided which includes an air blower unit 160 such as a preferred 20 H.P. Fuji Ring Compressor model 904A-7W, and an air conduit 162, wherein the air intake is filtered. The air conduit 162 enters into the process tank 110 and terminates in a nozzle array 164 in the form of a plurality of elongate tubes 166 which are directed toward the parts carrier 114. Air exits the process tank 110 via a filtered exhaust stack 165.

Referring now to FIGS. 2, 5, 6, 10 and 14, the plumbing 168 will be detailed.

Figure 14:
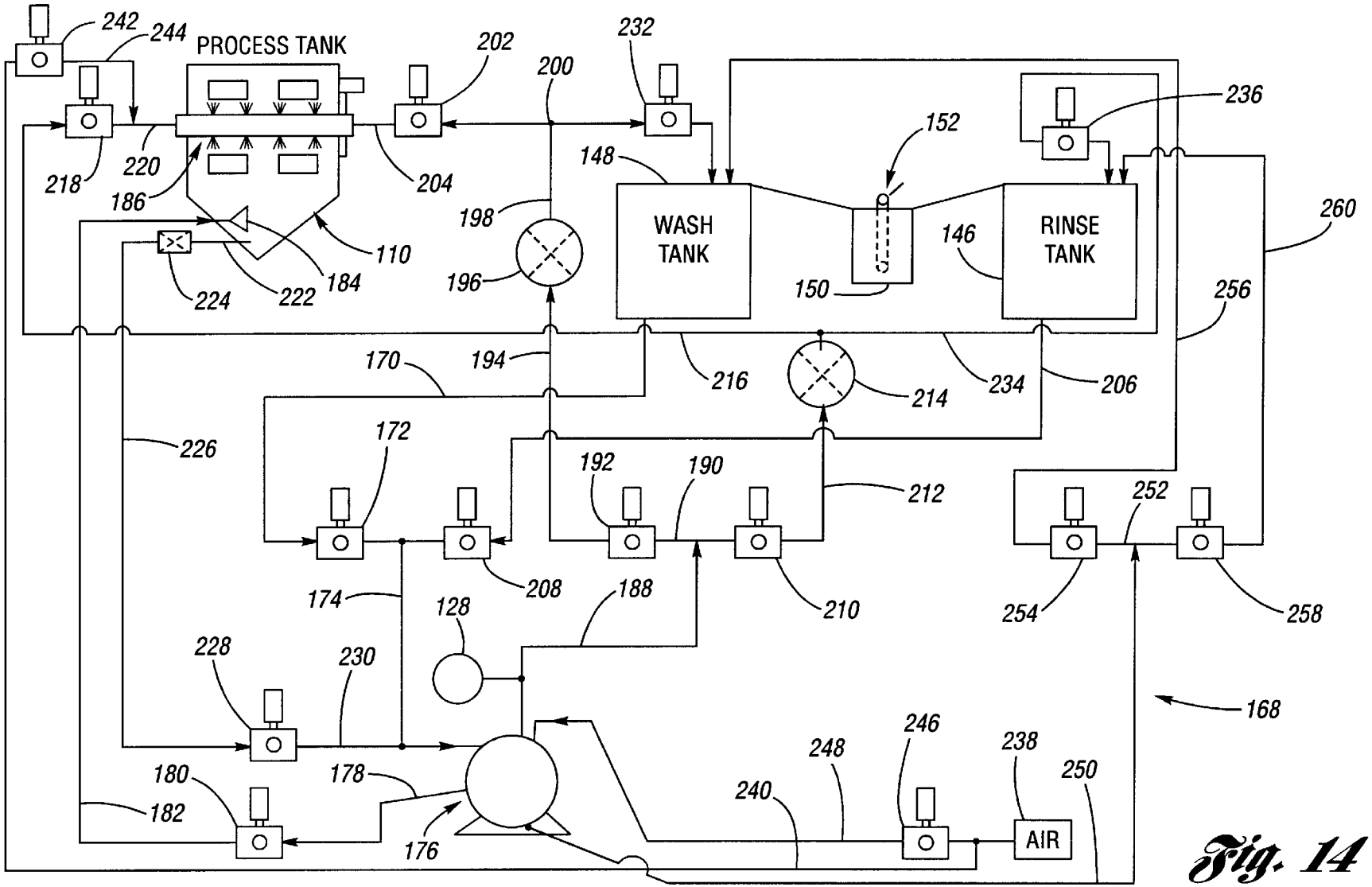
FIG. 14 is a plumbing schematic of the epicycloidic cleaning system according to the present invention.

FIGS. 5 and 14 depict the wash plumbing 168*a*.

Figure 8:
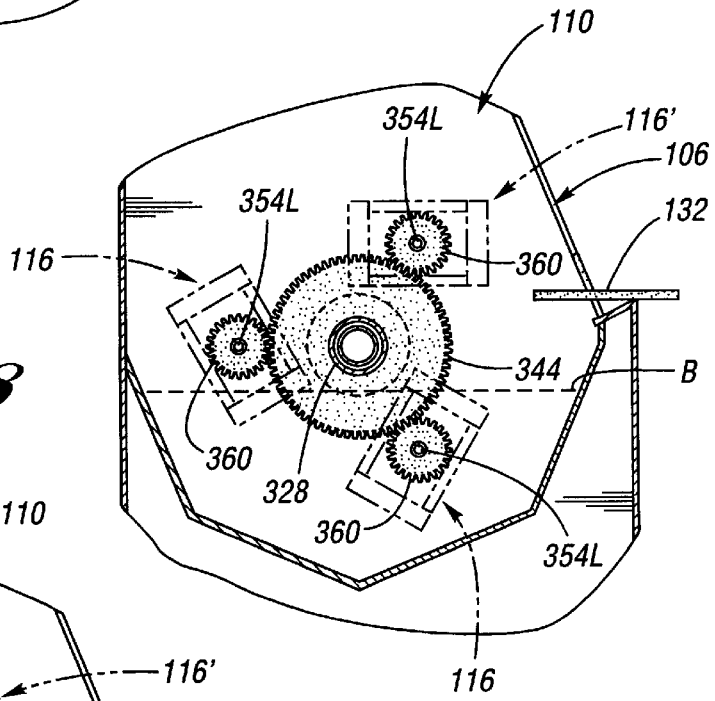
FIG. 8 is a partly sectional, partly broken-away view of the revolutional drive train of the epicycloidic drive mechanism of the epicycloidic cleaning system according to the present invention.

During stage one of the wash cycle, the wash plumbing provides wash solution to fill a wash bath in the process tank 110 (as for example a wash bath B height of just below the height of a driven shaft 328, as shown at FIG. 8). A line 170 exits a low point of the wash tank 148, goes through a wash inlet actuator valve 172, along line 174 to a pump 176 (such as a preferred 7.5 H.P. 3 phase 3450 RPM Gusher pump model 11031, which provides 200 GPM at 120' TDH), from the pump under pressure via line 188, through a wash return actuator valve 192, along line 194, through a filter 196 (such as a preferred FSI filter model BFN12-P-2-6-CS-150), along line 198 and line 200, through a wash spray actuator valve 202 and through line 204 into the central spray system 186. Additionally, from the pump 176, wash solution travels along line 178, through an enductor actuator valve 180, along line 182 into the process tank 110, and exits as an agitating stream at an enductor nozzle 184 (as for example a Bex model TOMP, composed of polypropelene).

During stage two of the wash cycle, the wash plumbing provides solution to the central spray system 186 and agitation of the wash solution bath in a closed path. The wash inlet actuator valve 172 is closed and a process tank drain actuator valve 228 is opened. Wash solution travels via line 222 which enters the process tank 110 at or about its lowest point, through a chip strainer 224 (as for a preferred example, an FSI filter model BFN11 style 2), through the process tank drain actuator valve 228 and through line 230 to the pump 176, whereupon it exits under pressure along line 188. The pressurized wash solution then travels along line 190, through the wash return actuator valve 192, along line 194, through the filter 196, along line 198 and line 200, through the wash spray actuator valve 202 and through line 204 into the central spray system 186. Additionally, from the pump age 176, wash solution travels along line 178, through the enductor actuator valve 180, along line 182 into the process tank 110, and exits as an agitating stream at the enductor nozzle 184. The enductor nozzle 184 causes agitation in the bath as an aid to parts cleaning as well as helping to move chips and other debris into the chip strainer.

FIGS. 6 and 14 depict the rinse plumbing 168*b*.

During stage one of the rinse cycle, the rinse plumbing provides rinse solution to fill a rinse bath in the process tank 110 (as for example a rinse bath B height of just below the height of the driven shaft 328, as shown at FIG. 8). A line 206 exits a low point of the rinse tank 146, goes through a rinse inlet actuator valve 208, along line 174 to the pump 176, from the pump under pressure via line 188, along line 190, through a rinse return actuator valve 210, along line 212, through a filter 214 (such as a preferred FSI filter model BFN12-P-2-6-CS-150), along line 216, through a rinse spray actuator valve 218 and into the central spray system 186 via line 220. Additionally, from the pump 176, rinse solution travels along line 178, through the enductor actuator valve 180, along line 182 into the process tank 110, and exits as an agitating stream at the enductor nozzle 184.

During stage two of the rinse cycle, the rinse plumbing provides solution to the central spray system 186 and agitation of the rinse solution bath in a closed path. The rinse inlet actuator valve 208 is closed and the process tank drain actuator valve 228 is opened. Rinse solution travels via line 222, through the chip strainer 224, through the process tank drain actuator valve 228 and through line 230 to the pump 176, whereupon it exits under pressure along line 188. The pressurized rinse solution then travels along line 190, through a rinse return actuator valve 210, along line 212, through a filter 214 (such as a preferred FSI filter model BFN12-P-2-6-CS-150), along line 216, through the rinse spray actuator valve 218 and into the central spray system 186 via line 220. Additionally, from the pump 176, rinse solution travels along line 178, through the enductor actuator valve 180, along line 182 into the process tank 110, and exits as an agitating stream at the enductor nozzle 184, wherein the enductor nozzle functions as described above.

FIGS. 5, 6 and 14 depict the drain plumbing. From a low point of the process tank 110, line 222 drains solution (rinse or wash), through the chip strainer 224, along line 226, through a process tank drain valve actuator valve 228, along line 230 and then into the pump 176, and from the pump 176 along line 188 and line 190. The route for wash solution is now from line 190, through the wash return actuator valve 192, along line 194, through the filter 196, along line 198, along line 200, through a dump wash actuator valve 232 and then into the wash tank 148. The route for rinse solution is now from line 190, through the rinse return actuator valve 210, along line 212, through the filter 214, along line 234, through a dump rinse actuator valve 236 and then into the rinse tank 146.

FIG. 14 depicts the purge system plumbing whereby the common plumbing lines are purged of solution from a current cycle before commencement of the next cycle, wherein there is a change of rinse and wash solutions between the prior and next cycles. Purge occurs after solution has been drained (pumped out) of the process tank at the conclusion of stage two of the wash and rinse cycles.

During a first stage of the purge cycle, the central spray system 186 is purged of solution. A source of pressurized air 238 delivers pressurized air to line 240, which travels through a purge spray system actuator valve 242, along line 244 and then into the central spray system 186 via line 220, whereupon the central spray system is purged of solution, which has now been blown into the process tank 110.

Thereafter, a secondary drain of the process tank 110 occurs, which repeats the drain plumbing particulars detailed hereinabove.

During a second stage of the purge cycle, the pressurized air from the source 238 also passes through a lines purge actuator valve 246, along line 248 and into the pump 176. The pressurization due to the pressurized air now causes solution (rinse or wash) to be forced along line 250 which is at the lowest point of the plumbing system 168. The solution (rinse or wash) and pressurized air travel to line 252. In the case of wash solution, from line 252 the wash solution and pressurized air travel through a wash purge return actuator valve 254, along line 256 and into the wash tank 148. In the case of rinse solution, from line 252 the rinse solution and pressurized air travel through a rinse purge return actuator valve 258, along line 260 and into the rinse tank 146.

With regard to the actuator valves, a preferred form thereof is an Apollo ball valve model 77-144-01BR/SS, operated by an Apollo actuator model 3T-05-00, which is, in turn, actuated pneumatically by an Asco pneumatic air valve model 5510083.

Figure 7:
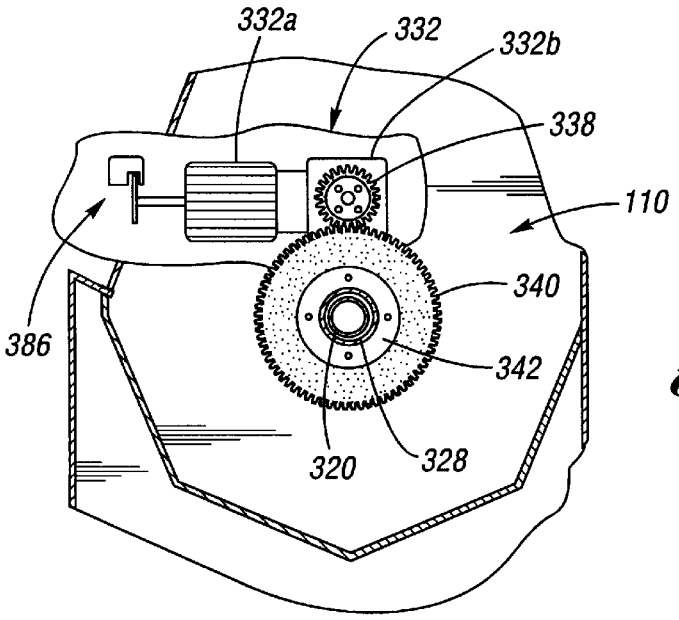
FIG. 7 is a partly sectional view of the rotational drive train of the epicycloidic drive mechanism of the epicycloidic cleaning system according to the present invention.
Figure 9:
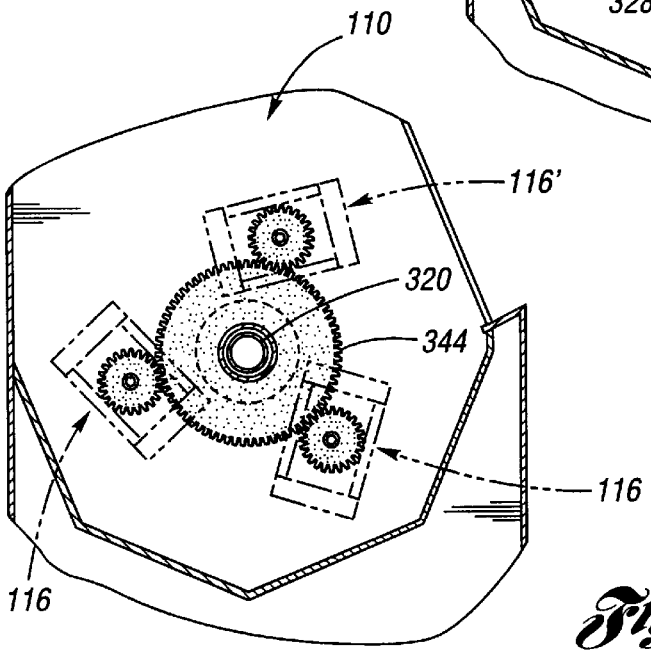
FIG. 9 is a partly sectional view similar to that of FIG. 8, at a just preceding rotational position.
Figure 10:
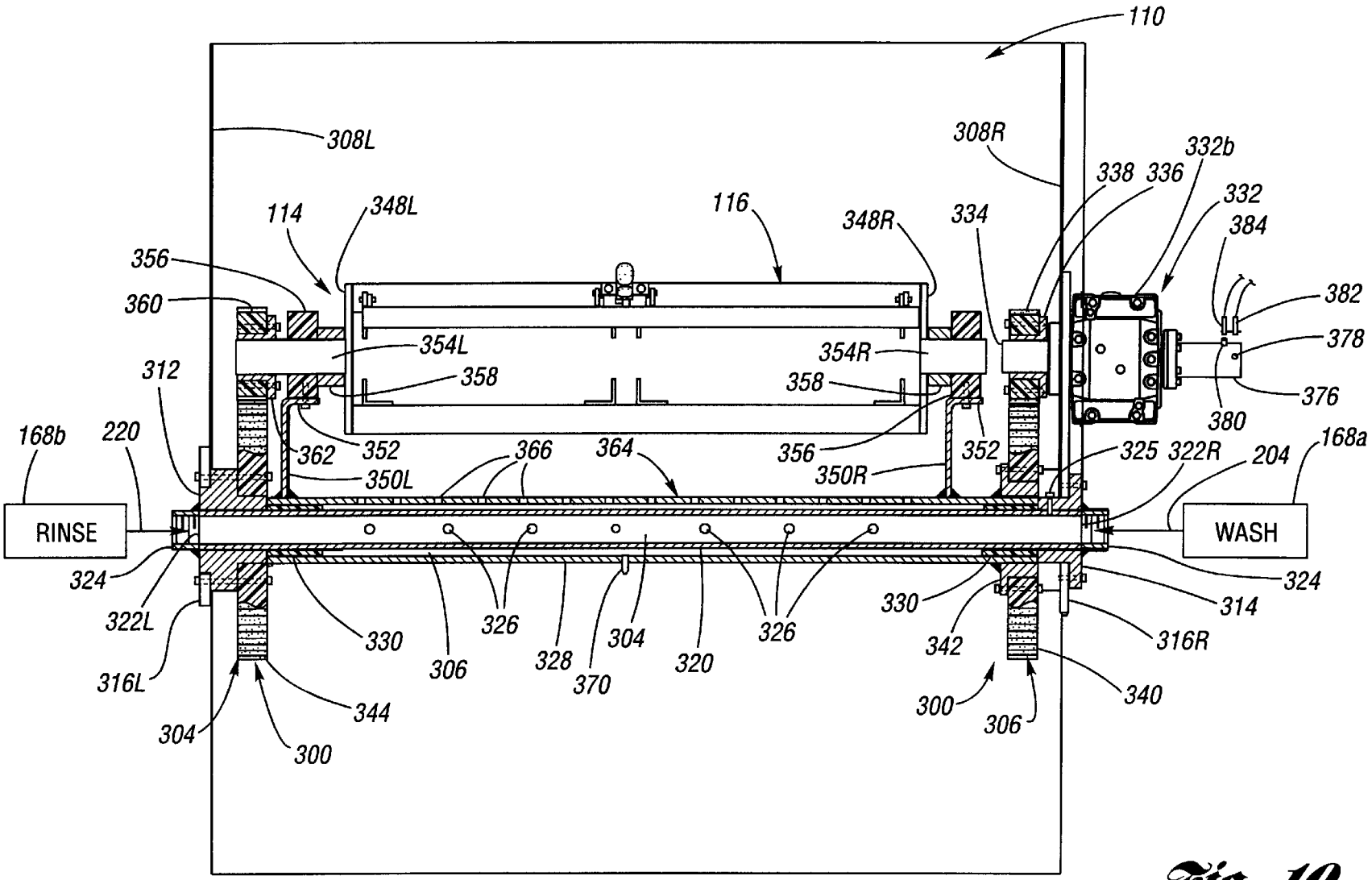
FIG. 10 is a partly sectional front view of the epicycloidic cleaning system at the process tank thereof, generally showing the parts carrier, the epicycloidic drive mechanism, and the central spray system.

Referring now to FIG. 10, the process tank 110 is composed of stainless steel and has a V-shape (see FIGS. 7 through 9). The process tank 110 is provided with opposing left and right sidewalls 308L, 308R which serve to support the parts carrier 114 and its associated epicycloidic drive mechanism.

A left coupling member 312, preferably composed of stainless steel, is sealingly connected with the left sidewall 308L via bolts and a left stiffening plate 316L. A right coupling member 314, also preferably composed of stainless steel, is sealingly connected with the right sidewall 308R via bolts and a right stiffening plate 316R. A hollow support shaft 320, preferably composed of stainless steel, is supportably received through the left and right coupling members 312, 314 so as to thereby affix the support shaft to the process tank sidewalls, wherein rotation of the support shaft is prevented by an operator removable bolt 325 at the right coupling member.

The support shaft 320 is fitted to the left and right coupling members 316L, 316R. The support shaft 320 has left and right orifices 322L, 322R which mate to respective threaded couplings 324 which are respectively welded to the left and right coupling members 316L, 316R. The threaded couplings 324 provide a connection to the wash plumbing 168*a* via line 220 and the rinse plumbing 168*b* via line 204. The support shaft, 320 is provided with a plurality of holes 326 regularly spaced along its length for providing solution outputs when the wash or rinse rinse plumbing is activated during a wash or rinse cycle, respectively, or during a purge therebetween.

A hollow driven shaft 328, also composed preferably of stainless steel, is concentrically centered on and mounted to the support shaft 320 by a pair of sleeve bearings 330 composed preferably of ultra high molecular weight (UHMW) plastic, upon which the driven shaft is rotatable with respect to the support shaft.

The epicycloidic drive mechanism 300 comprises a revolutional drive train 304 and a rotational drive train 306.

A prime mover 332, preferably in the form (see FIGS. 4 and 7) of an electric motor 332*a* and gear reduction drive unit 332*b* therefor (as for a preferable example a 2 H.P. AC gear motor and Sumitomo 73:1 SM-bevel Buddybox model KHM2A4105) has a (stainless steel) drive shaft 334 and is mounted to the stiffening plate 316R. The prime mover 332 is connected with a rotational drive train 306 for the parts carrier 114. In this regard, a (stainless steel) hub 336 is connected with the drive shaft 334 and a drive gear 338 is mounted thereupon by bolts and situated in the process tank 110. A driven gear 340 is gearingly interfaced with the drive gear 338 and is fixedly mounted to the driven shaft 328. In this regard, a (stainless steel) hub 342 is welded to the driven shaft 328 and the driven gear 340 is affixed to the hub 342 by bolts. Accordingly, when the prime mover 332 is actuated, the drive gear 338 causes rotation of the driven gear 340 and the driven shaft 328. The gears are preferably composed of polypropelene, but could be otherwise composed, such as for example of stainless steel. A gear ratio of 3 to 1 is preferred for reasons, which will become clear hereinbelow, related to there being three support frames 116.

A revolutional drive train 304 is situated at the opposite end of the driven shaft 328 and includes a sun gear 344 located inside the process tank 110 which is fixedly mounted to the left coupling member 312 via bolts so as to be concentrically disposed with respect to the support shaft 320.

As mentioned, the parts carrier 114 includes preferably three support frames 116, one support frame being shown at FIG. 10 for clarity. The support frames 116 each receivably interface with removable parts holders, such as for example the aforementioned baskets 318 (see FIG. 2). The parts carrier 114 includes left and right connector plates 350L, 350R which are fixedly connected in a radially disposed relation to the driven shaft 328, such as by welding. The left and right connector plates 350L, 350R are preferably composed of stainless steel. In the case of the preferred example wherein three support frames 116 are provided, each connector plate 350L, 350R has a truncated triangular shape, wherein each corner is truncated and has a right angle flange 352.

Each support frame 116 has a left and right rhomboidal plate 348L, 348R which is fixedly connected (as by welding) to left and right connector shafts 354L, 354R. Each support frame 346 is rotatably connected at the left and right connector shafts 354L, 354R respectively to the left and right connector plates 350L, 350R via a mounting block 356, composed preferably of UHMW plastic and bolts, wherein (stainless steel) spacers 358 serve to retain relative positioning of the support frame.

As shown at FIGS. 8, 9 and 10, the left connector shaft 354L is provided with a planetary gear 360 which forms a part of the revolutional drive train 304, wherein each planetary gear is gearingly interfaced with the sun gear 344. In this regard, a (stainless steel) hub 362 is fixedly mounted to the left connector shaft 354L and the planetary gear 360 is mounted thereon and affixed thereto by bolts. Accordingly, when the prime mover 332 is actuated, the rotational drive train 306 provides rotation of the parts carrier 114 and each support frame 116 as the driven shaft 328 rotates, while simultaneously the revolutional drive train 304 causes the support frames to revolve on the axis of the left and right connector shafts 354L, 354R, the combination of rotation with revolution thereby providing an epicycloidic movement of the support frames, as for example three revolutions of the support frames for each rotation of the parts carrier. The sun and planetary gears 344, 360 are preferred to be composed of polypropelene, but can be otherwise composed, such as of stainless steel.

The prime mover 332 has user selectable speeds, as for example four speeds selected on a page of the touch screen 122, as for a preferred example selectable among four speeds of the electric motor 332*a:* 125 RPM, 250 RPM, 800 RPM and 1,750 RPM. Other speeds may be chosen, or the speed may be continuously selectable over a range of speeds. The actual speed of rotation of the driven shaft 328 (and, consequently, the parts carrier 114) depends upon the gear reduction of the drive unit 332*b* of the prime mover 332 and the gear ratio between the drive gear 338 and the driven gear 340. For a preferred example, the drive unit may have a 73 to 1 ratio, and the drive gear to driven gear ratio may be 3 to 1, the reason for which will now be elaborated.

As shown at FIGS. 4 and 10, a spur shaft 376 of the drive unit 332*b* has a pair of ferromagnetic material studs 378, 380 located thereon in circumferentially offset relation, for example, offset of about 30 degrees. A pair of proximity switches 382, 384 which sense close-by ferromagnetic material are fixedly connected with the housing 102 in proximal relation to the studs 378, 380 at closest approach, respectively (as for example within one-eighth to one-quarter inch at closest approach). The proximity switches 382, 384 are axially aligned with respect to the spur shaft 376. When the lead stud 378 aligns with its respective lead proximity switch 382, power to the motor 332*a* is cut-off and a brake 386 (see FIGS. 4 and 7) is lightly applied, thereby greatly slowing rotation of the parts carrier 114. When the following stud 380 aligns with its respective following proximity switch 384, the brake 386 is firmly applied to stop rotation of the parts carrier. The brake is preferably a pneumatically actuated disc brake, preferably for example, a Tolomatic brake model 0705-0001 and a complementary Tolomatic 6" disc model 0801-1206.

The operation of the proximity switches 382, 384 and the brake 386 can be understood by reference to FIGS. 2, 7, 8 and 9. In order to load and unload parts 112 with respect to the support frames 116, a selected support frame 116' is brought into alignment with the main portal 106, as shown at FIGS. 2 and 8. In order to ensure that each support frame will be so aligned when the rotation of the driven shaft 328 stops at the rotative location shown at FIG. 9, the lead proximity switch 382 has activated, thereby cutting off power to the motor 332*a* and lightly applying the brake 386 so that rotation is greatly slowed, and upon the following proximity switch 384 being activated, the brake is firmly applied, whereupon the parts carrier comes to a stop at the position shown at FIG. 8. Thereafter, the operator jogs the parts carrier 114 so that each support frame 116 is brought successively into the load position of FIG. 8.

The central spray system 186 is characterized as follows.

Figure 11:
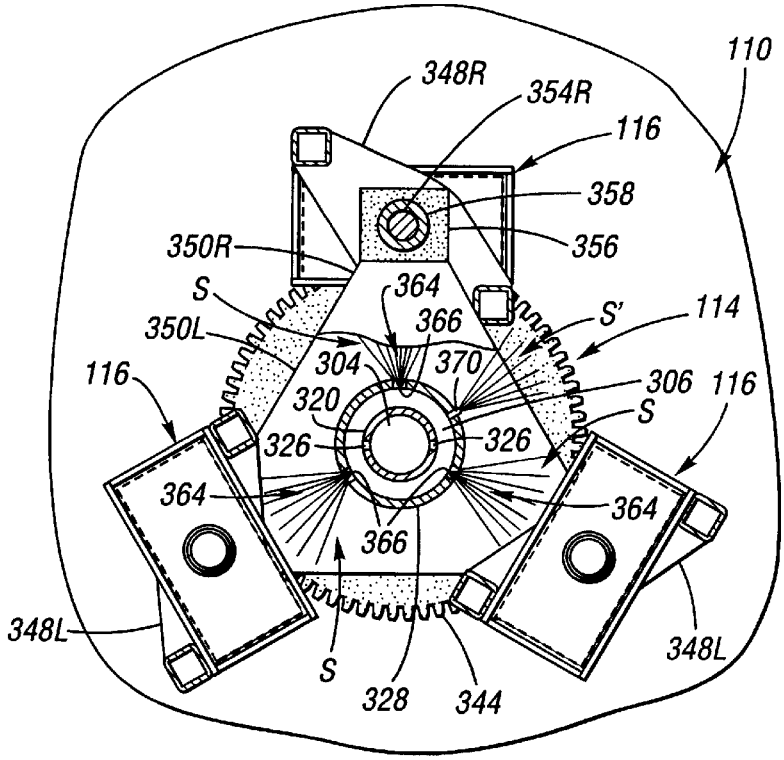
FIG. 11 is a partly sectional, partly broken-away, end view of the parts carrier of the epicycloidic cleaning system according to the present invention.

As shown at FIGS. 10 and 11, the driven shaft 328 is provided with a set 364 of regularly spaced spray apertures 366 for each support frame 346, wherein each set of spray apertures is disposed so as to radially face its respective support frame. In the preferred embodiment depicted, since there are three support frames 346, there are three sets 364 of spray apertures 366, one set for each respective support frame 116.

By way of preferred example only, the support shaft 320 is about two and one-half inches in diameter, has about three-eighths of an inch thick wall, and has about seven holes 326 of about three-quarter of an inch diameter located on each of two diametrically opposed sides thereof. The driven shaft 328 is about four and one-half inches in diameter, has about one-quarter of an inch thick wall, and has spray apertures 366 which are about one-eighth of an inch in diameter and spaced about two inches apart along its length. By way of example of the spray S from the spray apertures, 60 PSI is delivered the central spray system 186 at about 200 GPM.

The support shaft 320 receives rinse or wash solution (or pressurized air) into the central chamber 304 thereof and the pressure thereof causes its passage through the plurality of holes 326 and into the annular chamber 306 formed between the support shaft and driven shaft 328. With the annular chamber pressurized by the solution, the solution vigorously sprays S radially outwardly through the sets 364 of regularly spaced spray apertures 366 which are disposed so as to radially face, respectively, each support frame.

Accordingly, when the plumbing system 168 is delivering either wash or rinse solution at stage two of the respective rinse or wash cycles into the process tank 110, the respective solution sprays S out through the sets of spray apertures 366 continuously upon its respectively facing support frame 116. Importantly, this spray S encounters all sides axially as each support frame revolves (and, consequently, whatever parts are supported by the support frames). Further, the revolution of the support frames 116 results in the parts being jostled, so that it is expected that all facets of the parts will be subjected to spray during each or the rinse and wash cycles.

It is preferred to provide a cleansing nozzle 370 situated medially on the driven shaft 328 so that solution of each wash and rinse cycle will spray S' therefrom in a fan-like manner and thereby generally clean surfaces of the process tank 300 in general, including the portal door 108.

As a result of the multi-cyclic rotation of the support frames, wherein revolutional movement is superposed rotational movement, the parts are constantly exposed to solution spray, and the revolution superposed rotation movement immersibly through the solution bath is provided, the combination of which providing superb cleaning of the parts carried by the support frame. In this regard, the prime mover 332 direction of rotation is reversible, so that during portions of cycles and portions of stages of cycles the CPU 126 may cause the parts carrier 116 to move clockwise and during other portions counterclockwise. In this regard further, the prime mover 332 is capable of multiple speeds, so that during portions of cycles and portions of stages of cycles the CPU 126 may cause the parts carrier 116 to rotate faster or slower than during other portions.

Further, upon conclusion of either the rinse or wash cycles, pressurized air is selectively introduced by the plumbing system 168 to force solution of the present cycle back to its respective tank, prior to commencement of the next cycle. Accordingly, there is no mixing of the rinse and wash solutions during cycle change, and, therefore, the wash and rinse solutions have a maximal extended lifetime before changing is necessitated by contamination from the parts (as opposed to being necessitated because of solution cross-contamination).

FIG. 13 details preferred cycles and stages thereof, as well as which components of the epicycloidic cleaning system 100 are active thereduring, as indicated by connecting dots. In this regard, the valves open for each stage are those indicated by a corresponding dot (the others are closed).

Figure 15A:
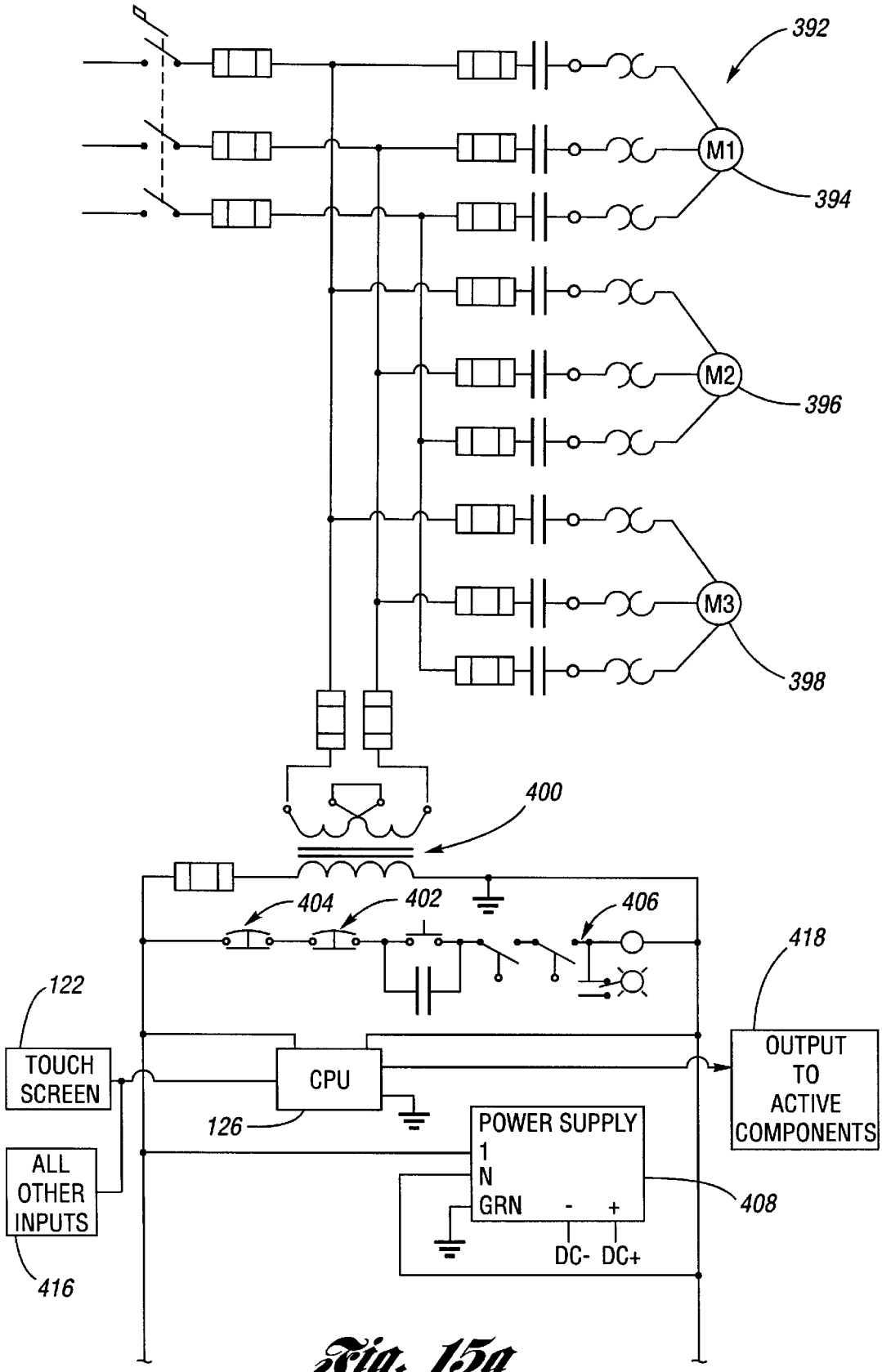
FIGS. 15*a* and 15*b* are collectively an electrical schematic of the epicycloidic cleaning system according to the present invention.
Figure 15B:
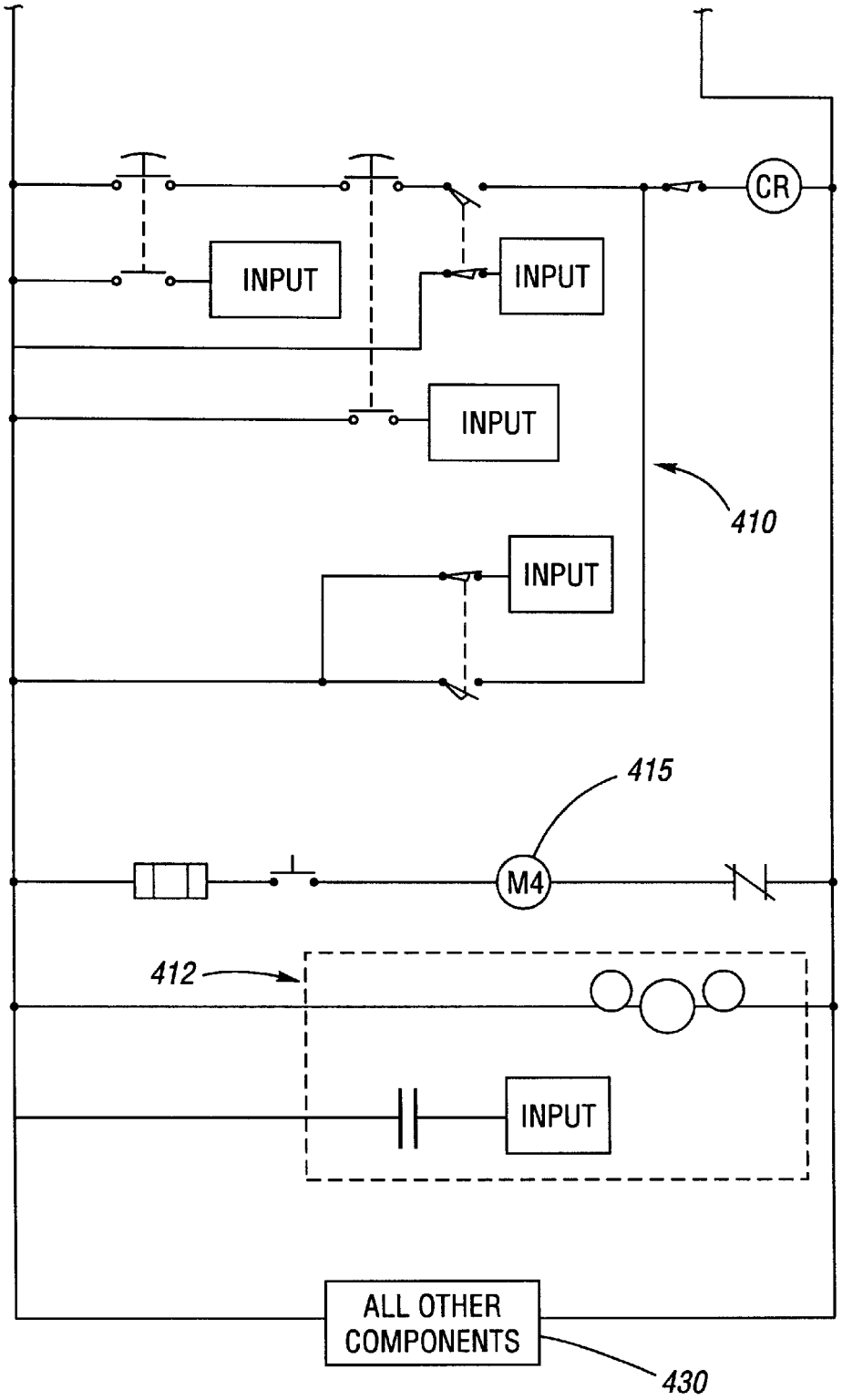

FIGS. 15*a* and 15*b* depict a schematic of a preferred electrical circuit 392 for the epicycloidic cleaning system 100. Of particular note are the motor 394 of the heater-blower unit 156, motor 396 of the pump 176, and motor 398 of the air blower 160, a 460 volt power transformer 400, a master start switch 402, master stop switch 404, a master on switch 406, the aforementioned CPU 126 and touch screen 122, a 24 volt power supply 408, limit switches 410 associated with the portal door 108 to detect open and closed conditions, motor 415 of the oil skimmer 152, and level sensor 412 of the over-flow tank 150 (such as a Warrick liquid level fill s.s. probe).

With regard to the CPU 126, inputs 416 from various button switches, limit switches and other data (as for example temperature sensors of the wash and rinse solutions) is sent to the CPU. The CPU 126 then processes the data and sends an output 418 to selectively actuate the various motors, relays, actuators and all other active components of the epicycloidic cleaning system 100. The touch screen 122 has a plurality of menu pages for user selection, for example, system selection page, cycle timing page, portal door close list page, pump supply page, solution tank temperature page, manual mode page, indicator page, speed page, and cycling page. At the bottom of FIG. 15*b,* other components 146 of a conventional nature are conventionally wired to the electrical circuit 392, as for example the natural gas burner 156, or other heating device. Any such component is integrated with the output 418 in a conventional manner for control by the CPU 126.

It is preferred, additionally, for the portal door actuator 140 to be sensitive to the presence of foreign objects (including an operator's hand or arm) at the main portal 106 whereupon during a portal door close, closure is halted via a safety relay 420 upon sensing a foreign object. Further in this regard to safety, it is preferred to provide an abutment rod 422 on the loading platform 132 which will strike the portal door 108 in advance of its coming near the bottom of the main portal so as to ensure an arm or hand cannot be struck by the portal door accidentally during a portal door close. Additionally, for safety, the prime mover 332 has a slip clutch and a variable frequency drive torque limiter wherein the rotation of the driven shaft 328 can be manually stopped by an operator's hand pressure (for example about 30 pounds of force) in order to ensure if some untoward event should happen, the rotation will cease.

Figure 12A:
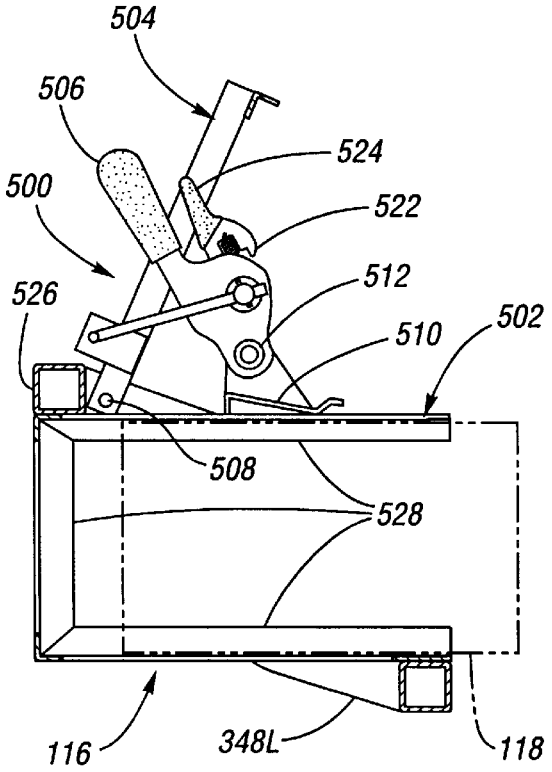
FIGS. 12*a* and 12*b* are partly sectional views of the support frame of the epicycloidic cleaning system according to the present invention, showing in particular a preferred clasp mechanism thereof.
Figure 12B:
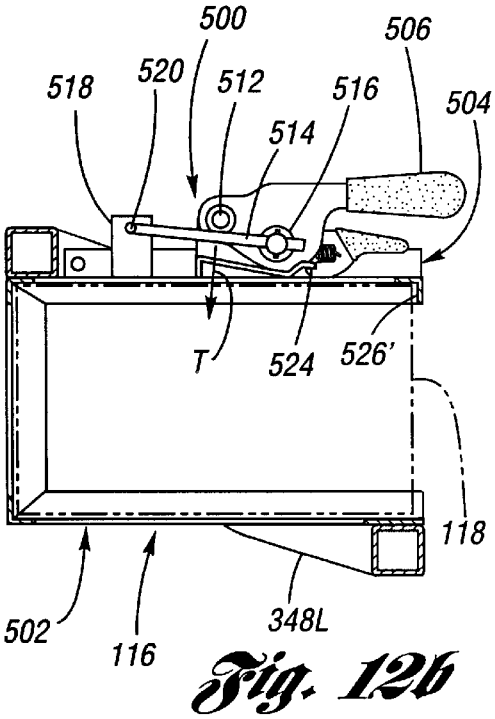

FIGS. 12*a* and 12*b* depict how the support frames 116 open to allow the baskets 118 to be removed therefrom. A preferred clasp mechanism 500 for the support frames 116 includes an over-camming clamp 506 manufactured by De-Sta-Co, model 341R-SS. Each support frame 116 is composed of a main component 502 and a top component 504 which is pivotally connected to the main component by a first pivot 508. A clamp mount 510 is affixed medially to the main component 502. The clamp 506 is pivotally connected to the clamp mount 510 via a second pivot 512. A rod 514 is pivotally connected to the clamp 506 Aria a third pivot 516 at one end and to a stanchion 518 connected with the top component 504 via a fourth pivot 520 at the other end.

The clasp mechanism 500 assures closure of the top component 504 with respect to the main component 502 via two modalities. Under a first modality, the clamp 506 is over-cammed into its locked position. This occurs when the rod 514 lies below the second pivot 512, as shown at FIG. 12*b*, whereupon tension T acts upon the clamp to retain it in the locked state. In a second modality, a hook 522 of a locking pawl 524 of the over-camming clamp 506 springably engages a bar 524 of the clamp mount 510.

The support frame 116 includes a pair of main support members 526 which connect by welding to the aforementioned left and right rhomboidal plates 348L, 348R. Connected with the main support members 526 are abutments 528, preferably in the form of angles, which guide and hold the baskets 118. When the top component 504 is locked down, as shown at FIG. 12*b,* the baskets are received holdably with respect to the support frame 116, in part via the top abutment 526' as the support frame moves epicycloidically. When the top component 504 is pivoted upwardly, as shown at FIG. 12*a,* the baskets 118 are free to be removed from the support frame 116.

To those skilled in the art to which this invention appertains, the above described preferred embodiment may be subject to change or modification. For example, the aforementioned cycles may be modified, or other cycles can be included with the epicycloidic cleaning system according to the present invention, such as for example a phosphate cleaning cycle or a deionization treatment, each having its own solution tank, associated plumbing with actuator valves, and associated components as indicated herein with respect to the wash and rinse cycles. Such change or modification can be carried out without departing from the scope of the invention, which is intended to be limited only by the scope of the appended claims.

What is claimed is:

1. An epicycloidic cleaning system comprising:

a housing;

a process tank located within said housing for holding a bath of at least one predetermined solution;

parts carrier means rotatably mounted within said process tank having a plurality of support frames for holding parts to be cleaned;

an epicycloidic drive mechanism for providing said plurality of support frames with a continuous epicycloidic movement comprising a rotational movement about a rotation axis and a revolutional movement superposed upon the rotational movement;

a spray system comprising a plurality of rows of spray sources for spraying the at least one predetermined solution, said plurality of rows being arranged parallel to the rotation axis and disposed substantially adjacent thereto, each row moving synchronously with said rotational movement so as to provide a spray radially onto a respective support frame; and means for selectively filling said process tank with the bath;

wherein during the epicycloidic movement, the at least one support frame is passable epicycloidically through the bath.

2. The system of claim 1, wherein said epicycloidic drive mechanism comprises:

a prime mover; and a rotational drive train connected to said prime mover and said parts carrier for providing said rotational movement.

3. The system of claim 2, wherein said epicycloidic drive mechanism further comprises:

a rotational connection of said plurality of support frames to said parts carrier; and a revolutionary drive train comprising a sun gear fixed in relation to said housing and at least one planetary gear affixed to said plurality of support frames, wherein said at least one planetary gear is gearingly meshed with said sun gear.

4. The system of claim 3, further comprising:

rinse tank means connected to said housing for supplying a rinse solution;

wash tank means connected to said housing for supplying a wash solution;

plumbing means for selectively filling said process tank with said bath selected from either of the rinse and wash solutions and delivering the selected rinse and wash solutions to said spray system; and air purge means for clearing a selected portion of said plumbing means and said spray system of the selected rinse and wash solutions.

5. The system of claim 4, wherein said spray system further comprises:

a stationary support shaft, said support shaft having holes formed therein;

a driven shaft concentrically disposed with said rotational movement, said driven shaft synchronously rotating with said plurality of support frames, said plurality of rows of spray sources being disposed in said driven shaft, a central chamber being formed between said support shaft and said driven shaft; and means for delivering the at least one predetermined solution to said support shaft;

wherein the at least one solution is delivered into said support shaft, passes through said holes into said central chamber and exits through said plurality of rows of spray sources radially toward the plurality of support frames.

6. The system of claim 5, further comprising a cleaning nozzle located medially on said driven shaft for spraying the at least one predetermined solution cleaningly upon said process tank.

7. The system of claim 1, wherein said epicycloidic drive mechanism further comprises:

a rotational connection of said plurality of support frames to said parts carrier; and a revolutionary drive train comprising a sun gear fixed in relation to said housing and at least one planetary gear affixed to said plurality of support frames, wherein said at least one planetary gear is gearingly meshed with said sun gear.

8. The system of claim 1, further comprising:

rinse tank means connected to said housing for supplying a rinse solution;

wash tank means connected to said housing for supplying a wash solution;

plumbing means for selectively filling said process tank with said bath selected from either of the rinse and wash solutions and delivering the selected rinse and wash solutions to said spray system; and air purge means for clearing a selected portion of said plumbing means and said spray system of the selected rinse and wash solutions.

9. The system of claim 1, wherein said spray system further comprises:

a stationary support shaft, said support shaft having holes formed therein;

a driven shaft concentrically disposed with said rotational movement, said driven shaft synchronously rotating with said plurality of support frames, said plurality of rows of spray sources being disposed in said driven shaft, a central chamber being formed between said support shaft and said driven shaft; and means for delivering the at least one predetermined solution to said support shaft;

wherein the at least one solution is delivered into said support shaft, passes through said holes into said central chamber and exits through said plurality of rows of spray sources radially toward the plurality of support frames.

10. The system of claim 1, further comprising a cleaning nozzle located medially on said driven shaft for spraying the at least one predetermined solution cleaningly upon said process tank.

* * * * *